US008439656B2

(12) United States Patent
Wolf

(10) Patent No.: US 8,439,656 B2
(45) Date of Patent: May 14, 2013

(54) LIQUID PUMP FOR AN INTERNAL COMBUSTION ENGINE AND DEVICE FOR HEATING LIQUID

(75) Inventor: Andreas Wolf, Tettnang (DE)

(73) Assignee: LICOS Trucktec GmbH, Markdorf (DE)

( * ) Notice: Subject to any disclaimer, the term of this patent is extended or adjusted under 35 U.S.C. 154(b) by 852 days.

(21) Appl. No.: 12/391,469

(22) Filed: Feb. 24, 2009

(65) Prior Publication Data

US 2009/0214359 A1 Aug. 27, 2009

(30) Foreign Application Priority Data

Feb. 27, 2008 (DE) ..... 10 2008 011 385

(51) Int. Cl.
*F04B 35/04* (2006.01)

(52) U.S. Cl.
USPC ..... 417/410.1; 417/214

(58) Field of Classification Search ..... 417/214, 417/410.1
See application file for complete search history.

(56) References Cited

U.S. PATENT DOCUMENTS 5,567,132 A * 10/1996 Dupuis et al. ..... 417/420
2002/0056433 A1* 5/2002 Nabeya et al. ..... 123/198 C
2003/0196863 A1* 10/2003 Faller et al. ..... 192/48.3

* cited by examiner

*Primary Examiner* — Anh Mai
*Assistant Examiner* — Brenitra M Lee
(74) *Attorney, Agent, or Firm* — Burr & Brown

(57) ABSTRACT

A liquid pump for an internal combustion engine having a housing in which a pump rotational shaft is accommodated, in particular a water pump of a heat exchanger circuit of a vehicle, and an eddy current arrangement is provided at least partially inside the housing of the liquid pump. The invention furthermore relates to a device for heating a liquid.

11 Claims, 1 Drawing Sheet

LIQUID PUMP FOR AN INTERNAL COMBUSTION ENGINE AND DEVICE FOR HEATING LIQUID

This application claims the benefit under 35 USC §119 (a)-(d) of German Application No. 10 2008 011 385.9 filed Feb. 27, 2008, the entirety of which is incorporated herein by reference.

FIELD OF THE INVENTION

The invention relates to a liquid pump for an internal combustion engine and further relates to a device for heating a liquid.

BACKGROUND OF THE INVENTION

Liquids for transmitting heat are used in a large number of technical fields, for example in order to conduct away heat which is generated or to discharge this heat elsewhere.

Internal combustion engines, in particular modern diesel engines, for example for utility vehicles or passenger cars, have in some cases such a high level of efficiency that under certain operating conditions the waste heat which is generated by the engine during the combustion of the fuel is not available to a sufficient degree. The waste heat of the internal combustion engine can be used, for example, to heat a vehicle's cab.

Furthermore, comparatively high proportions of undesired $NO_x$ emissions, whose generation is temperature-dependent, may occur during the cold start of internal combustion engines. The $NO_x$ emissions can be reduced by heating the cold engine more quickly or the associated maximum exhaust gas temperature which can be reached more quickly.

SUMMARY OF THE INVENTION

The object of the present invention is to make available an advantageous arrangement for raising the temperature of liquids which are used in a technical context, and of improving the use of internal combustion engines.

The invention is firstly based on a liquid pump for an internal combustion engine, having a housing in which a pump rotational shaft is accommodated, in particular a water pump of a heat exchanger circuit of a vehicle. According to the present invention, an eddy current arrangement is provided at least partially inside the housing of the liquid pump. This permits a means of generating and/or using heat in a liquid pump to be implemented in a particularly compact and comparatively effective way. In particular it is also advantageous that the generation of heat takes place at the location where heat is required and/or at the location where the liquid is used to transmit heat.

Furthermore, in an application situation there may generally be, in the interior of the housing of the liquid pump—which may be, for example, an internal combustion engine water pump—a comparatively high flow movement of the liquid, in particular a lasting and, if appropriate, turbulent flow, with the result that heat which is generated can be satisfactorily conducted away or an optimized flow of heat can take place, with the result being that the temperature of the liquid can rise quickly. Heat accumulation or local overheating of components and/or of the liquid, which is energetic and undesired in terms of the stressing of materials, can therefore advantageously be prevented.

The function of the eddy current arrangement with elements which can move in relation to one another is based on known eddy current principles (e.g., eddy current clutches) and is therefore not explained in more detail.

It is particularly advantageous that the eddy current arrangement is formed at least partially on an impeller wheel which can be rotated by means of the pump rotational shaft. The eddy current arrangement can therefore be positioned at preferred locations inside the housing, for example at different locations in the axial direction depending on the position of the impeller wheel. Furthermore, the eddy current arrangement can be positioned at locations which are different radial distances from the pump rotational shaft over the radial extent of the impeller wheel, and in this context the rotational speed of the respective parts of the eddy current arrangement also increases as the radial distance becomes larger. If appropriate, more than one eddy current arrangement can also be provided on an impeller wheel and/or a plurality of impeller wheels to which the eddy current arrangements can be attached and thus provided.

It is also advantageous that the eddy current arrangement has an eddy current element which is arranged on the impeller wheel and has a ferromagnetic insert. The eddy current element in which at least the predominant part of the heat-generating eddy currents is induced is therefore present on the impeller wheel. Rinsing of the heat-generating eddy current part by the liquid optimizes the transmission of heat from the eddy current element to the liquid.

The eddy current element is constructed, in particular, from a very good electrical conductor which is also a good conductor of heat, with the highly ferromagnetic insert which is accommodated therein and is made, for example, from a steel material. The eddy current element and/or its parts are, in particular, arranged concentrically about the pump rotational shaft, in particular in an annular shape. The part of the eddy current element which is present on the impeller wheel can be present integrally on the impeller wheel or be manufactured with it as one component or as a part which is attached thereto and is, for example, soldered, welded, bonded, screwed or latched to the impeller wheel. Significant or virtually all the edge sections of the eddy current element in which the eddy currents are generated are advantageously adjacent to the liquid in the pump housing. The impeller wheel is preferably composed of a material which is a good conductor of heat, in particular of a lightweight metal, for example aluminum, and/or of a suitable plastic material.

The heat which is generated at the impeller wheel, according to the principle of the formation of heat in an electrical conductor through which a current flows, can be discharged to the liquid directly and/or via further sections of the impeller wheel from the generation location.

Furthermore it is possible for the eddy current arrangement to comprise a switchable permanent magnet carrier which is equipped with a plurality of permanent magnets and, in the unswitched state, is offset in the direction of the eddy current element. The switchable permanent magnet carrier can be implemented in a particularly compact fashion in a liquid pump and/or adjacent to components of the liquid pump. The permanent magnet carrier is, in particular, positioned concentrically with respect to the pump rotational shaft, opposite the eddy current element.

For activation or deactivation of the eddy current arrangement which is usually required optionally and/or at certain times, and along with this for only temporary generation of eddy currents and therefore quantities of heat, it is preferred if only the permanent magnet carrier can be switched. In principle, the eddy current element can be switchable alternatively or additionally. This can preferably take place with a change in distance between the eddy current element and the permanent magnet carrier in the axial direction with respect to the pump rotational shaft, which can be implemented in a variety of different ways. A separation or a relative movement between the permanent magnet carrier with the permanent magnets and the eddy current element can take place by means of the offset movement of the permanent magnet carrier, which, in a way which is particularly saving of space, only needs to be offset by comparatively small distances in order to change from a switched state into an unswitched state, and vice versa.

An interruption in eddy currents and/or in the generation of heat which results therefrom is desired, for example, in operating situations in which the liquid is already sufficiently heated and/or the liquid is to have a temperature which is as low as possible.

For relative speed between the permanent magnet carrier and the eddy current element which is at least virtually negligible, it is possible that, in the unswitched state, the permanent magnet carrier bears in a frictionally locking fashion against a corresponding section of the impeller wheel or of the eddy current element, being, for example, connected thereto in a rotationally fixed fashion. A possibly only very low relative speed is also unproblematic and will generally not lead to heat being generated by eddy currents to any relevant degree.

The permanent magnet carrier is advantageously configured in such a way that in the switched state the permanent magnet carrier is offset in the direction away from the eddy current element. The relative movement can therefore be implemented between the permanent magnet carrier with the permanent magnet and the eddy current element with the ferromagnetic insert, as a result of which the eddy currents are induced.

In one advantageous embodiment of the present invention, in the switched state the permanent magnet carrier comes to bear against a fixed section in order to resist rotation of the permanent magnet carrier due to eddy current torques induced therein by the eddy current element. It is therefore ensured in the switched state that by means of a rotational movement of the eddy current element, torques acting on the permanent magnet carrier do not cause the permanent magnet carrier to be entrained with the rotating eddy current element, or possibly cause it to be entrained only to an insignificant degree. The torques are generated, in particular, by magnetic fields which are generated by the eddy currents and which interact with the permanent magnets of the permanent magnet carrier. These torques may be resisted reliably by, for example, a frictionally locking or non-positively locking connection of the permanent magnet carrier to the fixed section. The fixed section on which the permanent magnet carrier comes to bear in the switched state may, if appropriate, be roughened in order to obtain an increased coefficient of friction and/or may have a toothing profile or the like which is matched to a corresponding profile on the permanent magnet carrier.

In the switched state, the permanent magnet carrier advantageously comes to bear against the fixed section, which may be, for example, a section of the housing of the liquid pump or some other fixed section adjacent to the liquid pump housing, in particular on the internal combustion engine.

An electromagnet device is preferably provided for switching the permanent magnet carrier. The permanent magnet carrier can be switched or offset axially in a defined manner by electrically generated magnetic forces. This is advantageous in as far as the permanent magnet carrier can be moved by means of magnetic forces owing to its permanent magnets. Furthermore, the electromagnet device can quickly and reliably switch the permanent magnet carrier by switching energization on and off.

Finally, it is further possible that the electromagnet device can be arranged outside a pump space to which the liquid is applied. In particular electrically conductive regions or energized regions of the electromagnet device can therefore be separated from the liquid, which thus prevents undesired energization of electrically conductive parts.

Basically, the elements of the eddy current arrangement and the switching unit for switching the permanent magnet carrier, for example the electromagnet part, can also be arranged inside the pump housing.

The invention also relates to a device for heating a liquid, wherein in contact with the liquid there is an impeller wheel which can be driven in rotation and which has an eddy current arrangement which is arranged at least partially on the impeller wheel and by means of which the heat which is generated during the formation of eddy currents can be transmitted to the liquid. Eddy currents can therefore advantageously be generated without current-conducting contact with a power source, as a result of which application in liquids is unproblematic in terms of safety aspects.

The conductor through which current flows can advantageously be directly in contact with the liquid to be heated. The heat which is generated in the process can therefore be utilized better.

Furthermore, the advantages which have already been explained above can also be achieved for the device for heating a liquid by means of the eddy current arrangement described above.

BRIEF DESCRIPTION OF THE DRAWINGS

Further advantages and features of the invention are explained in more detail by means of the two highly schematic exemplary embodiments of the invention.

DETAILED DESCRIPTION OF THE INVENTION

Figure 1:
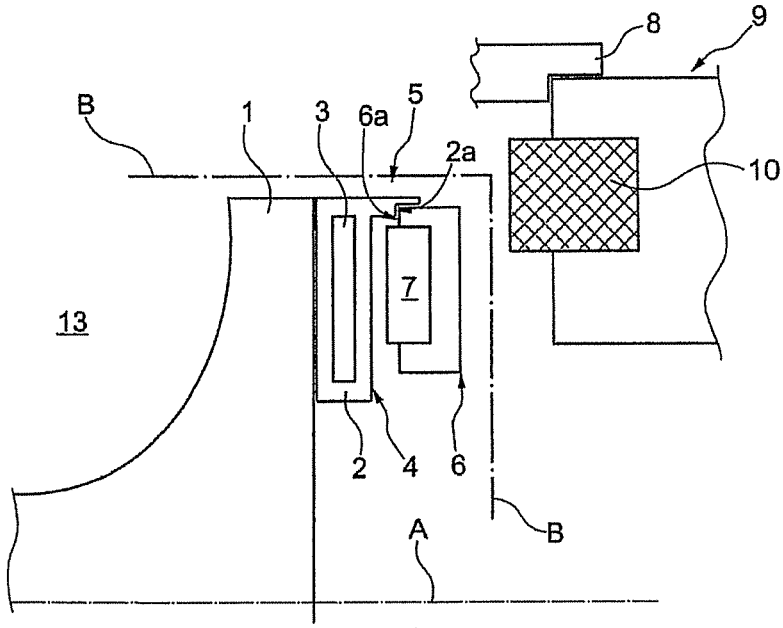
FIG. 1 shows a radially outer section of a liquid pump according to the invention.
Figure 2:
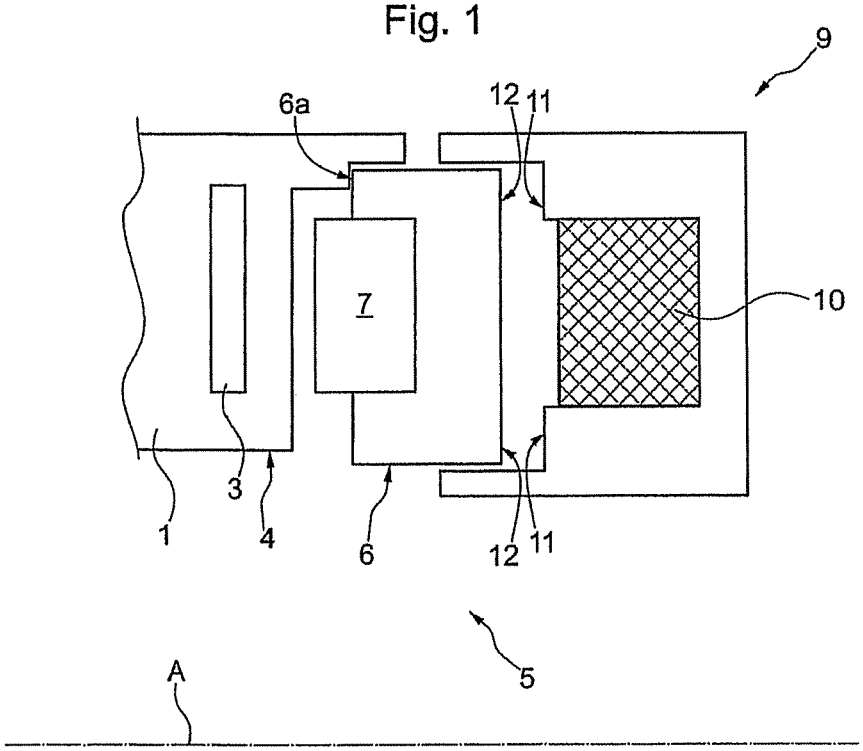
FIG. 2 shows an alternative arrangement, also in highly schematic form, of the detail shown in FIG. 1.

In the two exemplary embodiments according to FIGS. 1 and 2, the same reference symbols are used for corresponding elements.

FIGS. 1 and 2 each show an unswitched state of the arrangement according to the invention.

A water pump impeller wheel 1 rotates about shaft axis A shown in FIG. 1. The wheel 1 is connected in a frictionally locking or positively locking fashion to an annular metal ring element 2, in particular made of a lightweight metal, for example aluminum, with an integrated ferromagnetic annular ring 3, for example made of steel. If the water pump impeller wheel 1 is composed of aluminum or a similar lightweight metal, the metal ring element 2 can be an integral component of the water pump impeller wheel 1.

The metal ring element 2 with the ring 3, which is embodied, for example, as a flat ring, forms an eddy current element 4 of an eddy current arrangement 5. The eddy current arrangement 5 also comprises a permanent magnet carrier element 6 with permanent magnets 7 which are accommodated thereon, wherein the permanent magnet carrier element 6 is located axially opposite the eddy current element 4 with respect to the pump rotational shaft axis A. As a result of the magnetic effect of the permanent magnet 7, the permanent magnet carrier element 6 which is mounted in such a way that it can move axially along axis A is attracted toward the ring 3, wherein a stop 6*a* of the permanent magnet carrier element 6 comes to bear against a corresponding stop 2*a* on the metal ring element 2. The axial pressing of the stop 6*a* against the corresponding stop 2*a* allows a gap to remain between the remaining parts of the permanent magnet carrier element 6 and the eddy current element 4 and/or between the permanent magnet 7 and the metal ring element 2.

As a result of the frictionally, but non-positively locking connection between the permanent magnet carrier element 6 and the eddy current element 4 at the axial stops 2*a* and 6*a* in an unswitched state (explained in more detail below), the permanent magnet carrier element 6 is directly rotated by the rotating water pump impeller wheel 1 through contact with the eddy current element 4. Consequently, there is no difference in rotational speed between the water pump impeller wheel 1 and the permanent magnet carrier element 6.

On the side of the eddy current element 4 facing away from the permanent magnet carrier element 6, there is an electromagnet arrangement 9 which is provided with a coil 10 and which, for example according to FIG. 1, bears against a fixed housing section 8. According to FIG. 2, the electromagnet arrangement 9 engages radially (with respect to pump rotational shaft axis A) around the inside and the outside of the permanent magnet carrier element 6.

If the coil 10 is switched on or energized (by a mechanism not shown in the figures), the permanent magnet carrier element 6 is attracted away from eddy current element 4 axially against a corresponding fixed section axial stop face 11, for example against sections of the electromagnet arrangement 9, and the direct connection between the permanent magnet carrier element 6 and the eddy current element 4 is eliminated. If the permanent magnet carrier element 6 has been previously entrained in rotation by the water pump impeller wheel 1, it is braked in its rotational movement, in particular to a standstill or a rotational speed of zero. In order to resist rotation of the permanent magnet carrier element 6 due to the eddy current torque which then occurs between the permanent magnet 7 and the eddy current element 4, it is possible, if appropriate, to provide, for example, an additional or highly roughened frictional face for increasing the coefficient of friction on axial stop faces 11 and/or 12 (see FIG. 2) on the electromagnet arrangement 9 or on the permanent magnet carrier element 6, respectively.

Since, in the switched state, there is a difference in rotational speed between the drive rotational speed of the water pump impeller wheel 1 (and thus the eddy current element 4) and the rotational speed of permanent magnet carrier element 6 (which speed could be zero), eddy currents are generated in the metal ring element 2. Owing to the eddy currents, the metal ring element 2 and/or the eddy current element 4 are heated, and this heat is transmitted directly and/or indirectly via the water pump impeller wheel 1 to the liquid 13 which surrounds the water pump impeller wheel 1 (see FIG. 1), for example, of a cooling water current drive motor.

A housing of the liquid pump, a portion of which is shown in the figures, is indicated in highly simplified form according to line B in FIG. 1, in particular without sealing arrangements, with the liquid being accommodated inside the housing B.

LIST OF REFERENCE NUMERALS

1 Water pump impeller wheel
2 Metal ring element
2*a* Corresponding stop for 2
3 Ferromagnetic ring
4 Eddy current element
5 Eddy current arrangement
6 Permanent magnet carrier element
6*a* Corresponding stop for 6
7 Permanent magnet
8 Housing section
9 Electromagnet arrangement
10 Coil
11 Stop face for 9
12 Stop face for 6
13 Liquid

The invention claimed is:

1. A liquid pump for an internal combustion engine, comprising a housing in which a pump rotational shaft is accommodated, and an eddy current arrangement provided at least partially inside the housing of the liquid pump, wherein at least one member of the eddy current is moveable axially in parallel to the axis of the rotational shaft.

2. The liquid pump according to claim 1, further comprising an impeller wheel that is rotated by the pump rotational shaft, wherein the eddy current arrangement is formed at least partially on the impeller wheel.

3. The liquid pump according to claim 2, wherein the eddy current arrangement comprises an eddy current element that is arranged on the impeller wheel and has a ferromagnetic insert.

4. The liquid pump according to claim 3, wherein the eddy current arrangement further comprises a switchable permanent magnet carrier that is equipped with a plurality of permanent magnets and, in an unswitched state, is offset axially in a direction toward the eddy current element.

5. The liquid pump according to claim 4, wherein the permanent magnet carrier, in a switched state, is offset axially in a direction away from the eddy current element.

6. The liquid pump according to claim 5, further comprising a fixed section, wherein, in the switched state, the permanent magnet carrier bears against the fixed section to resist eddy current torques acting on the permanent magnet carrier from the eddy current element.

7. The liquid pump according to claim 5, further comprising a fixed section, wherein, in the switched state, the permanent magnet carrier bears against the fixed section.

8. The liquid pump according to claim 5, further comprising an electromagnet device for switching the permanent magnet carrier.

9. The liquid pump according to claim 8, wherein the housing includes a space for the liquid and the electromagnet device is arranged outside said space.

10. A water pump for a heat exchanger circuit of a vehicle comprising the liquid pump of claim 1.

11. A device for heating a liquid, comprising a rotatable impeller wheel in contact with the liquid and an eddy current arrangement arranged at least partially on the impeller wheel such that heat which is generated during formation of eddy currents by the eddy current arrangement is transmitted to the liquid, wherein at least one member of the eddy current arrangement is moveable axially in parallel to the rotational axis of the impeller wheel.

* * * * *

UNITED STATES PATENT AND TRADEMARK OFFICE

CERTIFICATE OF CORRECTION

PATENT NO. : 8,439,656 B2
APPLICATION NO. : 12/391469
DATED : May 14, 2013
INVENTOR(S) : Andreas Wolf It is certified that error appears in the above-identified patent and that said Letters Patent is hereby corrected as shown below:

In the Claims

Column 6, line 20: Please add "arrangement" after -- current --

Signed and Sealed this
Seventeenth Day of September, 2013

Teresa Stanek Rea
*Deputy Director of the United States Patent and Trademark Office*